US006001195A

United States Patent [19]

Kajiwara et al.

[11] Patent Number: 6,001,195

[45] Date of Patent: Dec. 14, 1999

[54] TI-NI-BASED SHAPE-MEMORY ALLOY AND METHOD OF MANUFACTURING SAME

[75] Inventors: Setsuo Kajiwara; Takehiko Kikuchi; Kazuyuki Ogawa; Shuichi Miyazaki; Takeshi Matsunaga, all of Ibaraki, Japan

[73] Assignee: National Research Institute for Metals, Japan

[21] Appl. No.: 08/768,467

[22] Filed: Dec. 18, 1996

[30] Foreign Application Priority Data

Mar. 22, 1996 [JP] Japan ..... 8-066820

[51] Int. Cl.[6] ..... C22C 14/00; C22C 19/03; C22K 1/00

[52] U.S. Cl. ..... 148/402; 148/407; 148/409; 148/563

[58] Field of Search ..... 148/402, 403, 148/407, 409, 561, 563, 564

[56] References Cited

U.S. PATENT DOCUMENTS 5,149,381 9/1992 Grewe et al. ..... 148/403

5,588,466 12/1996 Benz et al. ..... 137/831

OTHER PUBLICATIONS

S. Miyazaki et al., "Shape Memory Characteristics of Sputter–Deposited Ti–Ni Thin Films" *Materials Transactions*, JIM, v. 35, No. 1 (1994), pp. 14–19.

S. Kajiwara et al., "Strengthening of Ti–Ni shape–memory films by coherent subnanometric plate precipitates", *Philosophical Magazine Letters*, 1996, V. 74, No. 3, pp. 137–144.

S. Kajiwara et al., "Formation of nanocrystals with an identical orientation in sputter–deposited Ti–Ni thin films", *Philosophical Magazine Letters*, 1996, V. 74, No. 6, pp. 395–404.

*Primary Examiner*—George Wyszomierski

*Attorney, Agent, or Firm*—Wenderoth, Lind & Ponack, L.L.P.

[57] ABSTRACT

To remarkably improve shape memory properties without the need for strictly controlling the composition, the present invention provides a Ti—Ni-based shape-memory alloy having a titanium content within a range of from 50 to 66 atomic %, which comprises an amorphous alloy heat-treated at a temperature of from 600 to 800 K., in which sub-nanometeric precipitates generating coherent elastic strains are formed and distributed in the bcc parent phase(B2).

4 Claims, 6 Drawing Sheets

TI-NI-BASED SHAPE-MEMORY ALLOY AND METHOD OF MANUFACTURING SAME

FIELD OF THE INVENTION

The present invention relates to a Ti—Ni-based shape-memory alloy and a method of manufacturing same. More particularly, the present invention relates to a novel Ti—Ni-based shape-memory alloy which is useful as an actuator for a micro-valve or a micro-machine without the need for a strict control of composition and which has a largely improved shape-memory property, and a method of manufacturing same.

PRIOR ART AND PROBLEMS

As an alloy having shape-memory properties, Ti—Ni-based alloy has conventionally been known. A method of manufacturing this Ti—Ni-based alloy into a thin-film alloy is also known.

The thin-film shape-memory alloy is expected to be applicable to various precision areas. In the case of Ti—Ni-based shape-memory alloy thin film, a method for improving shape-memory properties such as shape recovering ability and recovery strain is known, which comprises crystallizing an amorphous alloy thin film vapor-deposited by sputtering, for example, by annealing the thin film at a temperature higher than the crystallization temperature, and then heat-treating the film at various temperatures.

However, the conventional technique has problems such that the improving effect of shape-memory properties is not sufficient, that the above-mentioned method for improving these properties requires strict control of the chemical composition of the Ti—Ni-based alloy, and furthermore that two stage heat treatments are required. Under such circumstances, therefore, it is very difficult even to obtain a limited improvement of shape memory properties and to reduce the manufacturing cost.

Therefore, the present invention has an object to provide a novel Ti—Ni-based shape-memory alloy which overcomes these drawbacks in the conventional technology as described above and allows remarkable improvement of shape-memory properties by a simple means, and a method of manufacturing same.

SUMMARY OF THE INVENTION

As means to solve the above-mentioned problems, the present invention provides a Ti—Ni-based shape-memory alloy having a titanium content within a range of from 50 to 66 atomic %, wherein sub-nanometeric precipitates generating coherent elastic strains in the parent phase are distributed.

Further, the present invention provides also a method of manufacturing the above-mentioned alloy, which comprises the step of heat-treating an amorphous Ti—Ni-based alloy at a temperature within a range of from 600 to 800 K.

DETAILED DESCRIPTION OF THE INVENTION

Figure 1:
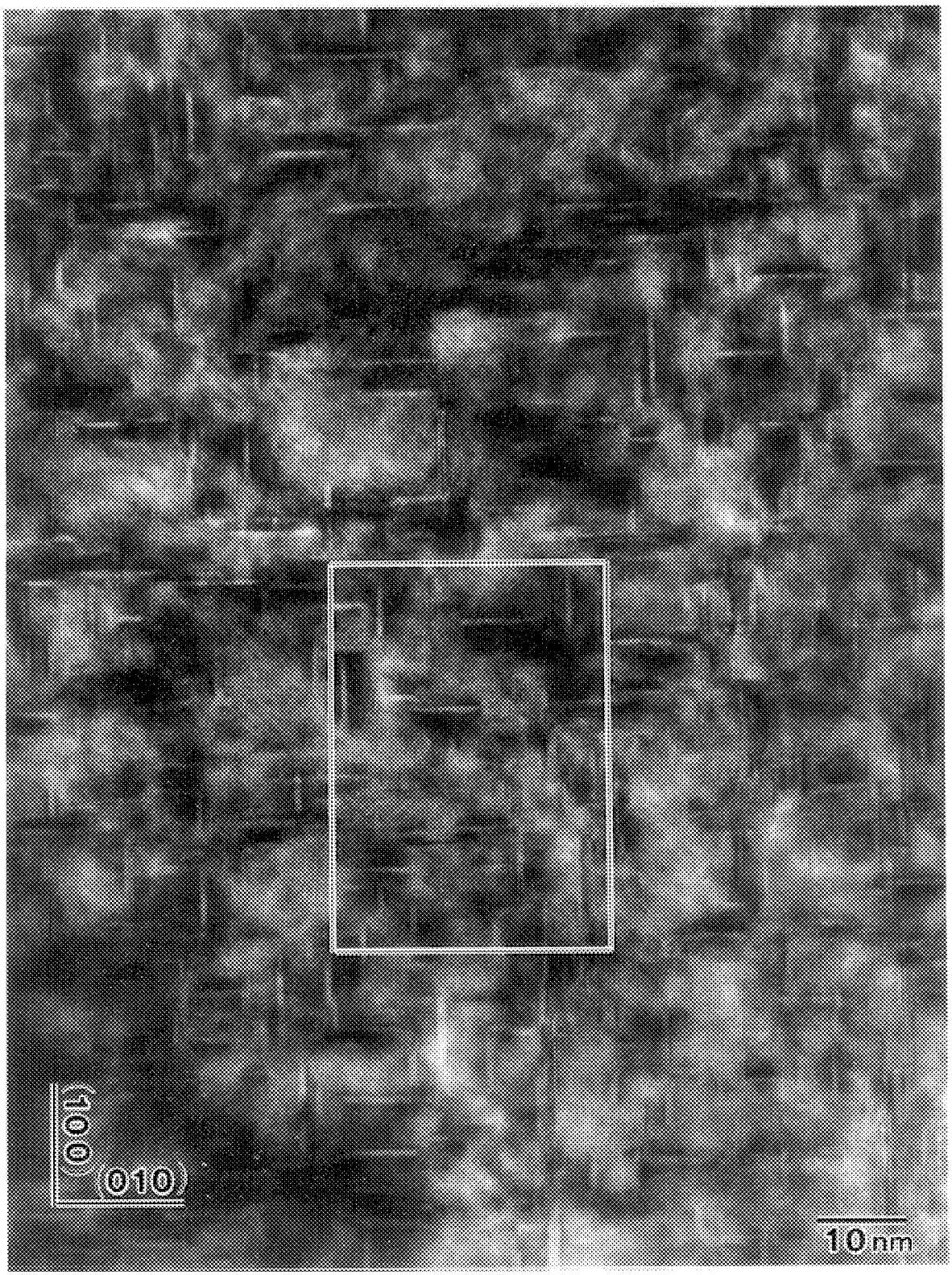
FIG. 1 shows a high-resolution electron photomicrograph illustrating the structure of an alloy thin film as an example of the present invention.

The present invention makes it possible to remarkably improve shape-memory properties such as shape recovering ability and recovery strain through the construction as described above.

As to the chemical composition itself of the alloy, other elements may be added or mixed as impurities to this alloy comprising Ti (titanium) and Ni (nickel), so far as these elements does not impair the shape-memory properties of the invention.

With a titanium content of under 50 atomic %, it becomes difficult to achieve the object of the invention, and it is also the case with a titanium content of over 55 atomic %.

In the target alloy, a special nanometer-scale precipitate is distributed in the parent phase thereof, and this precipitate produces a coherent elastic strain between the precipitate and the parent phase. The term "coherent elastic strain" as herein used means an elastic strain caused by connection of the slightly different crystal lattice of the precipitate with that of the parent phase. In the present invention, an alloy having such a feature is manufactured by applying a heat treatment to an amorphous alloy at a temperature within a range of from 600 to 800 K.

The heat treatment temperature is limited within the range of from 600 to 800 K., and the specimen must be heated directly from the amorphous state, in the present case, from the as-deposited state. Typical heat treatment conditions are, for example, as follows:

Time: 10 minutes to 3 hours

Atmosphere: Vacuum or an inert gas such as argon

Heating rate: 5 to 50 K./minute

Cooling: Rapid cooling.

Needles to mention these conditions are not limitative. In the already crystallized Ti—Ni-based alloy, generation and distribution of the above-mentioned precipitate are not observed by this heat treatment, and a remarkable improvement of properties is unavailable. With a temperature of over 800 K., an appropriate precipitate is not formed. With a temperature of under 600 K., diffusion of atoms becomes slower, and no precipitate is generated within a practicable period of time. In the both cases, a remarkable improving effect of the properties is unavailable.

The amorphous Ti—Ni-based alloy may be manufactured, for example, by the vapor deposition process into a thin film, or by any other appropriate method, and there is no particular limitation in this respect.

It should particularly be noted that the alloy of the invention in the form of a thin film is expected to be used in such applications as an actuator for a micro-valve or a micro-machine hereafter, and is therefore a very important material.

The alloy and the manufacturing method thereof of the present invention are now described further in detail by means of examples. The invention is not however limited by the following examples.

EXAMPLES

Using a Ti—Ni target material, thin films of an amorphous Ti—Ni alloy contain 48.2 atomic % Ni were formed on a glass substrate by argon ion sputtering. The thickness of the films was about 7 $\mu$m and its composition was determined by electron probe X-ray microanalysis.

Figure 2:
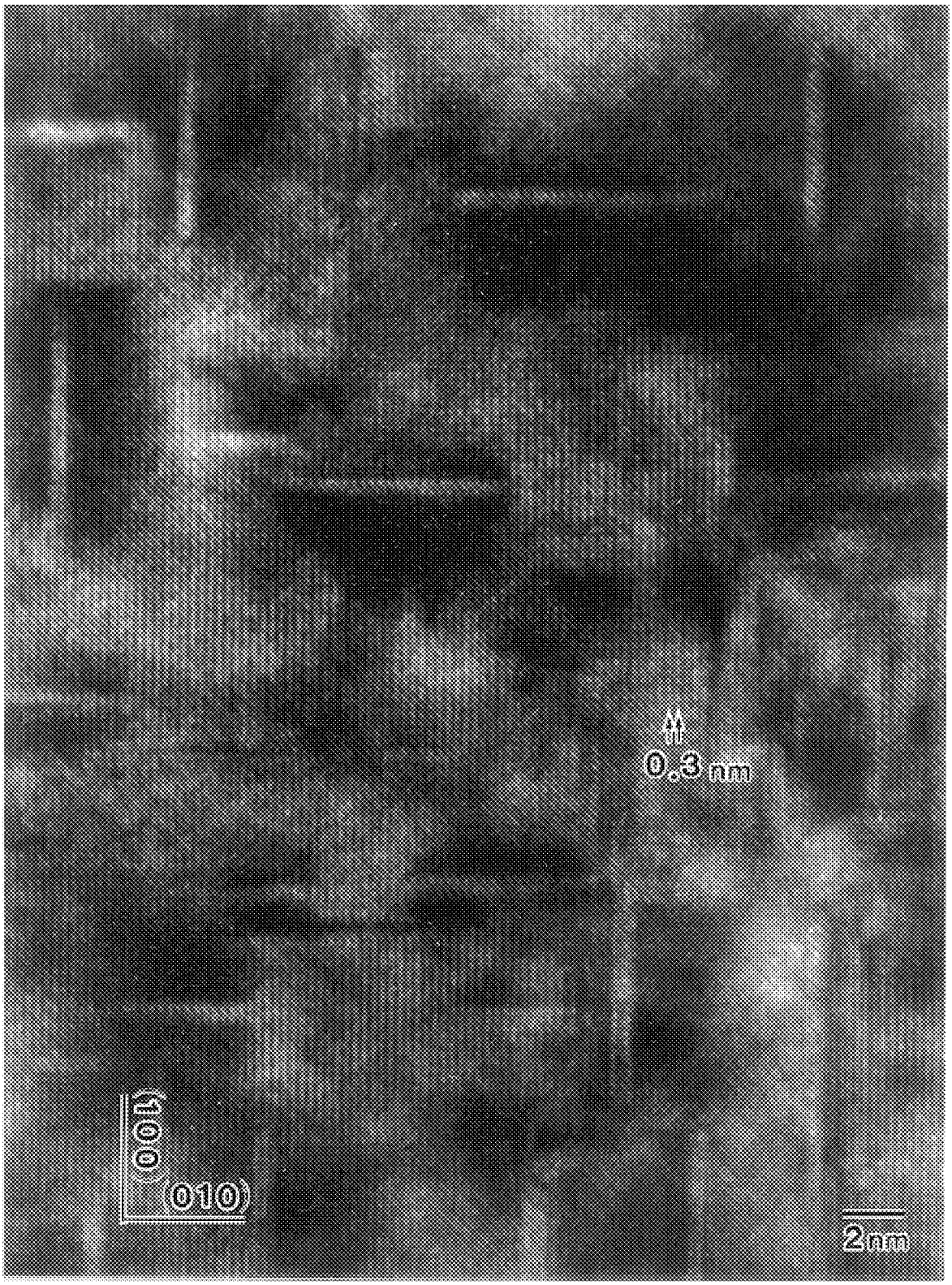
FIG. 2 shows an enlarged micrograph of the framed region of to FIG. 1, revealing subnanometric plate precipitates and coherent elastic strains.

A thin film heat-treated at 745 K. for 1 hr was observed by means of a high-resolution electron microscope. FIG. 1 illustrates an example of electronmicrograph thereof. FIG. 2 is an enlarged micrograph thereof. As is known from the micrographs of FIGS. 1 and 2, a number of thin plate precipitates are produced and distributed in the parent phase. These precipitates appear along the {100}bcc plane of the parent phase bcc(B2 type), and take the form of a disk having a thickness of about 0.5 nm (2 to 3 lattice planes) and a radius of from about 5 to 10 nm. The precipitates are distributed at intervals of about 10 nm, i.e., in a nanometer scale. The precipitate was confirmed to be Ti-rich by EDS analysis of field emission electron microscope.

Figure 3:
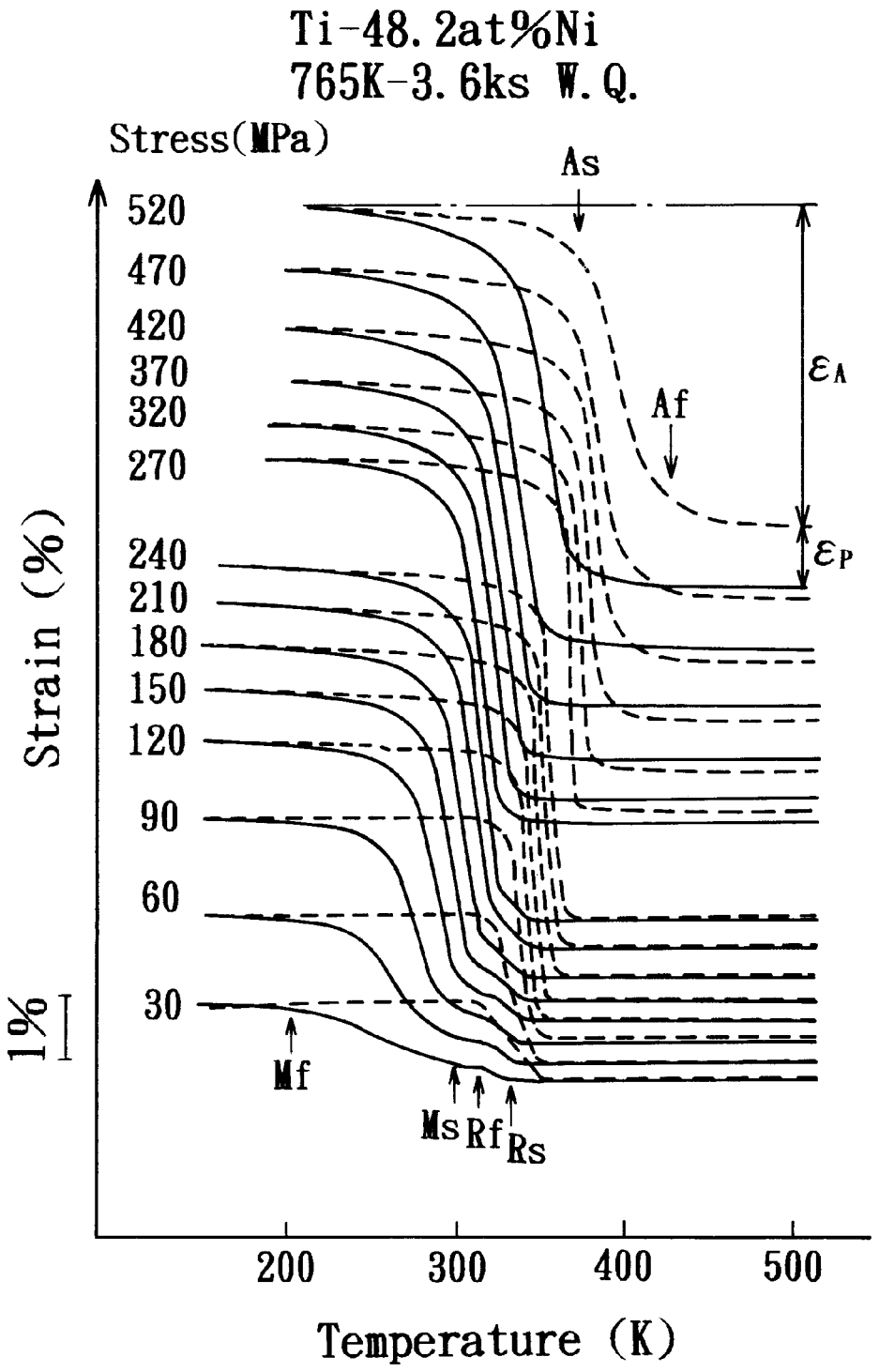
FIG. 3 shows various curves illustrating the results of thermal cycle tests under constant loads.

For a specimen heat-treated at 765 K. for 1 hr, changes in elongation were evaluated through thermal cycles under various loads. This specimen contained the same kind of precipitates as mentioned above. FIG. 3 shows the result. As shown in this figure, there is no permanent strain under loads of up to 240 MPa, and a large shape recovery strain as 6% is available.

Figure 4:
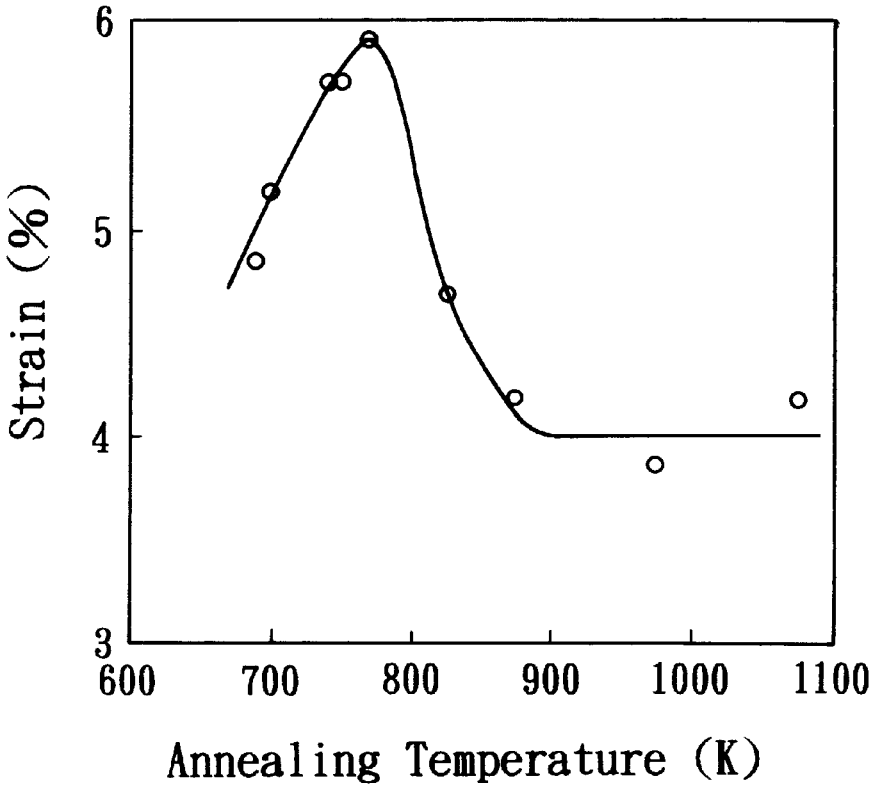
FIG. 4 shows a curve illustrating the relationship between maximum shape recovery strain and the heat treatment temperature.

FIG. 4 illustrates the result of evaluation of the relationship between the heat treatment temperature and the maximum shape recovery strain, indicating availability of a recovery strain of 5 to 6% through an annealing at a temperature within a range of from 700 to 800 K.

Figure 5:
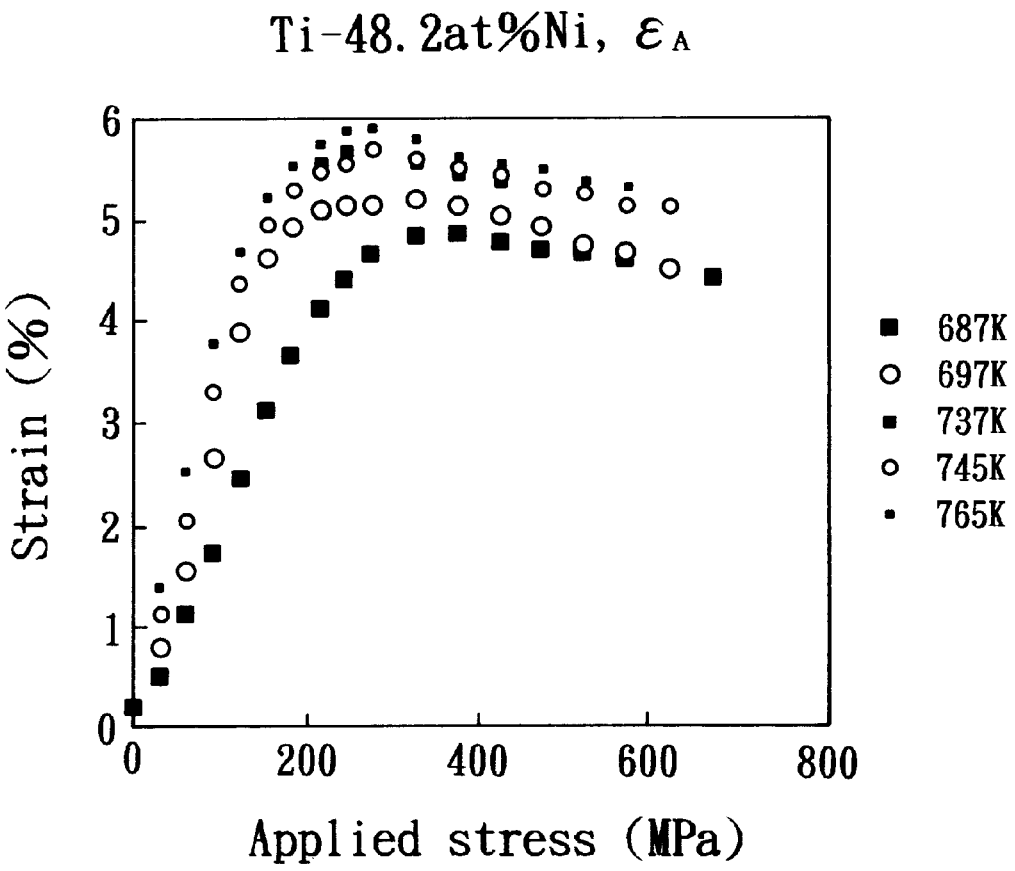
FIG. 5 shows the relationship between a load (external stress) and shape recovery strain for various heat treatment temperature.

FIG. 5 shows the relationship between shape recovery strain and stress under load, various heat treatments.

FIG. 5 reveals that a recovery strain of at least 4.5% is obtained with a stress range of from 200 to 670 MPa. The maximum loadable stress is 670 MPa.

Figure 6:
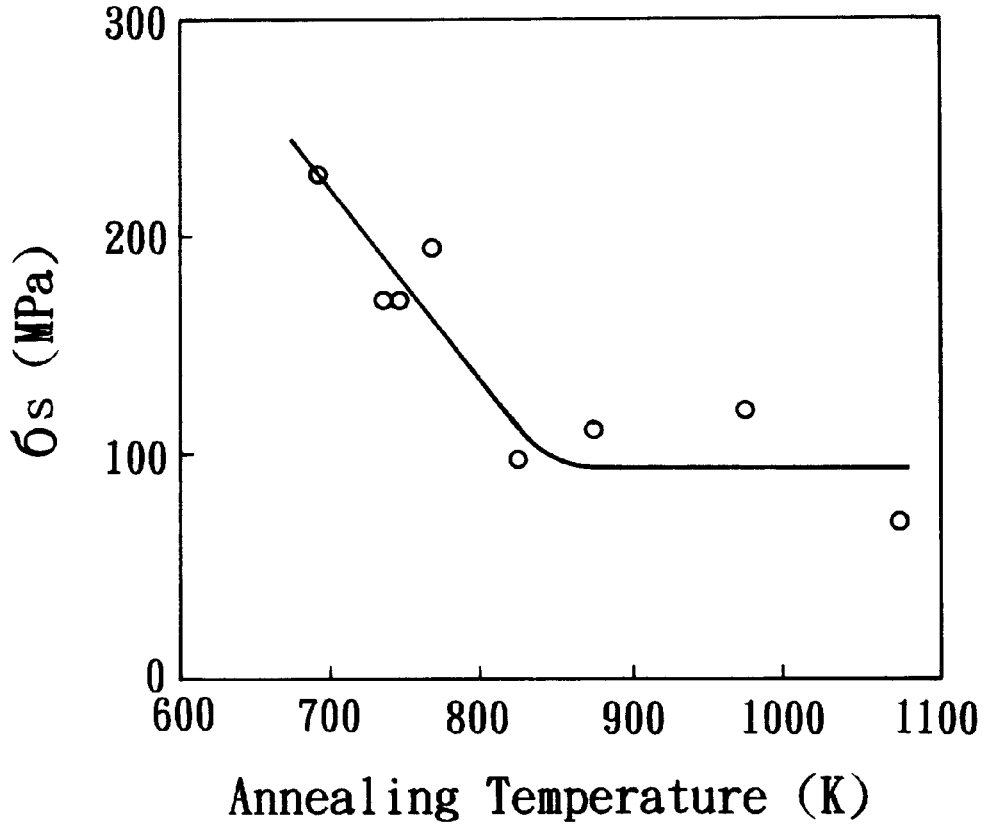
FIG. 6 shows the relationship between critical stress for slip and the heat treatment temperature.

FIG. 6 illustrates the effect of the heat treatment temperature on the maximum stress loadable within a range in which a permanent strain (slip deformation) is not introduced into the sample.

It is confirmed, from the example as described above, that the invention permits remarkable improvement of shape-memory properties as compared with the conventional process.

According to the present invention, shape-memory properties are remarkably improved through a heat treatment at a temperature of from 600 to 800 K. without the need for strictly controlling the composition or heat treatment. It is also possible to largely reduce the manufacturing cost.

What is claimed is:

1. A Ti—Ni-based shape-memory alloy having a titanium content within a range of from 50 to 66 atomic %, said alloy comprising sub-nanometric precipitates generating a coherent elastic strain is distributed in a mother phase.

2. A Ti—Ni-based shape-memory alloy as claimed in claim 1, wherein said precipitate is one formed through a heat treatment of an amorphous Ti—Ni-based alloy at a temperature within a range of from 600 to 800 K.

3. A Ti—Ni-based shape-memory alloy thin film comprising the alloy as claimed in claim 1.

4. A Ti—Ni-based shape-memory alloy thin film comprising the alloy as claimed in claim 2.

* * * * *